US005431335A

United States Patent [19]

Gimeno

[11] Patent Number: 5,431,335

[45] Date of Patent: Jul. 11, 1995

[54] LIGHT-WEIGHT CONTAINER

[75] Inventor: D. Emilio M. Gimeno, Alicante, Spain

[73] Assignee: Iberoamericana Del Embalaje S.A., Spain

[21] Appl. No.: 207,134

[22] Filed: Mar. 7, 1994

[30] Foreign Application Priority Data

Mar. 5, 1993 [ES] Spain ..... 9300583

[51] Int. Cl.[6] ..... B65D 5/42; B65D 5/22

[52] U.S. Cl. ..... 229/191; 229/918

[58] Field of Search ..... 229/191, 915, 918, 919

[56] References Cited

U.S. PATENT DOCUMENTS

| | | | |
|---|---|---|---|
| 2,844,293 | 7/1958 | Whitney | 229/191 |
| 2,885,137 | 5/1959 | Guoyer | 229/191 |
| 2,934,250 | 4/1960 | Stotz | 229/191 |
| 3,055,573 | 9/1962 | Carter | 229/191 |
| 3,268,147 | 8/1966 | Burger | 229/191 |
| 3,375,967 | 4/1968 | Robinson | 229/191 |
| 3,917,156 | 11/1975 | Baudet | 229/318 |
| 4,799,620 | 1/1989 | Vilella | 229/191 |

FOREIGN PATENT DOCUMENTS

| | | | |
|---|---|---|---|
| 622399 | 9/1962 | Belgium | 229/918 |
| 76883 | 4/1983 | European Pat. Off. | 229/191 |
| 2261943 | 9/1975 | France | 229/918 |
| 2279638 | 2/1976 | France | 229/918 |
| 2634457 | 1/1990 | France | 229/191 |

*Primary Examiner*—Gary E. Elkins

*Attorney, Agent, or Firm*—Ostrolenk, Faber, Gerb & Soffen

[57] ABSTRACT

A shallow open top container intended for the packing of perishable products, such as fresh fruit, is constructed from a board of stampable material and includes a rectangular bottom, long side panels or cheeks, and short end panels. The latter are considerably greater in height than are the long side panels. In the upper part of each corner of the container there are small transverse partitions arranged to form corresponding supports on which another container rests in an adjoining plane above the plane of the first mentioned container. The transverse partitions also provide angular positioning ridges that extend slightly above the end panels. Angular positioning ridges at the corners of a lower container extend upward into lower edge corner cutouts of an upper container that is stacked immediately above the lower container.

11 Claims, 2 Drawing Sheets

FIG. 1
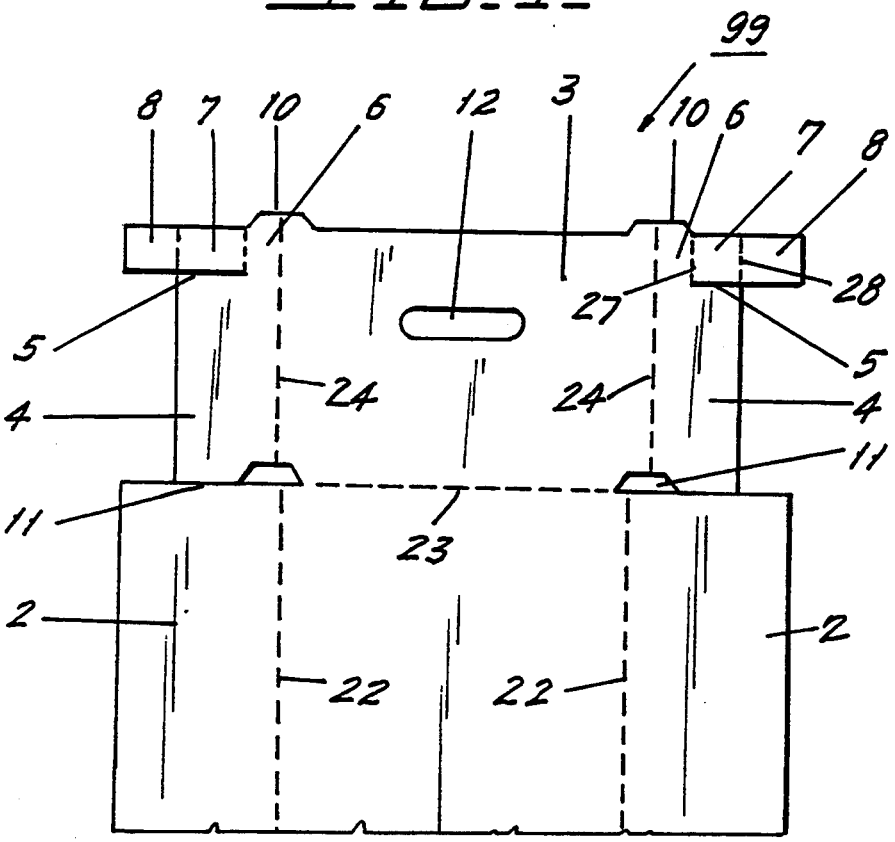
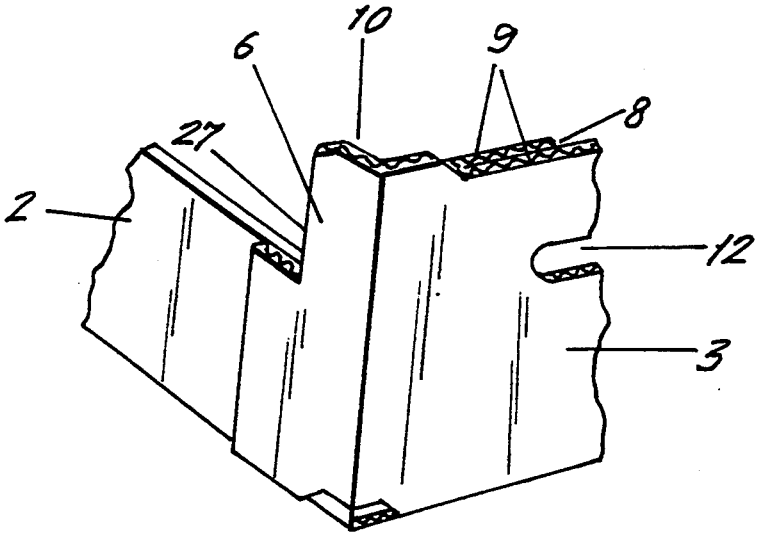
FIG. 2

LIGHT-WEIGHT CONTAINER

BACKGROUND OF THE INVENTION

This invention relates to tray-like boxes or containers intended for the storing and transportation of perishable products, and in particular relates to such containers that are generally open boxes which have means for supporting several of such containers in a vertical stack.

Usually the longer length side panels of these containers are not as tall as the end panels, with the result that, between every two stacked boxes, wide openings are formed on their long panels sides so that the air necessary for good ventilation and accordingly the preservation of perishable products packed in the containers, can circulate freely.

The prior art, as exemplified by the disclosure of Utility Model No. 285,668, includes a container that constitutes a tray which is extremely strong due to the fact that its ends have, articulated along the entire length of their upper edge, a wide panel which is swung towards the inside of the container and rests against the inner side of the end itself, thereby forming a double wall.

The wide panel in question has, on both ends, extensions which are located within the container and are divided into two substantially similar sectors which define a first sector located transversely between the end and the adjoining long side. The second sector of these extensions rests against and is attached by adhesive to the inner surface of the contiguous side.

Formed in the corners of the box thus established are triangular reinforcing prisms which also constitute pillars on which an adjoining higher box will rest.

These boxes, also have the important feature that from the upper edge of each corner there extends a short positioning ridge formation which forms a dihedral angle and, in coincidence with it, the lower edge of each corner has a slot made therein and that, upon the placing of the boxes one on top of the other, the ridge formations of each box will be housed within the cutouts made in the lower edge of the corners of the superimposed box.

This box offers great mechanical strength during stacking, assuring the stability of the loads formed. In practice, and as a variant of the aforesaid prior art container, new containers have been designed which are adapted to the requirements of each case which are made necessary at times by the goods to be packed and in other cases by reasons of assembly and/or economy, this matter being of great importance if it is considered in terms of large-scale production, in which any saving, either of material or of labor, small as it may be, assumes great importance.

In accordance with these considerations, the company which is the owner of the container described above has designed another container which, based on the model discussed above, contains, introduced in it, certain improvements by which benefits both of a practical nature and of an economic character are obtained. Therefore, the present application constitutes a variant of the container disclosed in Model No. 285,668 which is used to pack perishable articles of light weight for which the container does not require exceptional characteristics of strength since the pressures which are developed during the stacking are much less, particularly in perpendicular direction.

SUMMARY OF THE INVENTION

The object of the present invention, as indicated above, is a light-weight container of the open-box type which has been improved with regard to its features of design, organization, and assembly and which is constructed and assembled with relative ease employing means customary in the cardboard industry, with the use of a minimum amount of labor and utilizing to a maximum the material of which said container is constructed.

One feature of the container embodying the instant invention consists of small sides or end panels have a greater height than the longer side cheeks, so that, when the boxes are stacked, a wide opening is formed between every two stacked boxes on both of the long sides, through which opening the aeration of the goods packed takes place.

In accordance with another important feature of this invention, the end panels of the box have, on their sides, special extensions or flaps which are turned around, surrounding the corner of the box, until being applied against the outer surface of the adjoining long side panels, to which it is attached, advantageously, by adhesive.

Each side flap of the end panels has its top part prolonged laterally, forming extensions which are divided into three successive sectors that are turned towards the inside of the box, the first of which remains attached to and stiffened by the flap itself, which surrounds each corner of the box. The two other sectors are detached from said flap and turned towards the inside of the container, the first sector occupying a diagonal plane in the corresponding corner of the box and the last sector being turned away, forming an obtuse angle with the preceding transverse sector, so as to lie against and be adhesively attached to the inner surface of the end from which it extends.

Another characteristic of the box according to the instant invention is that the third and last sector of the said extensions, when brought against and attached to the inner surface of the end itself, substantially increases the thickness thereof, so that its upper edge is transformed into a substantial seat on which another box, which is arranged in the adjoining upper plane, will rest.

In accordance with another feature of the box according to the instant invention corner ridges are formed in the shape of a dihedral angle. These ridges extending from the upper edge of each corner of the container in the same manner and with the same characteristics as in the box previously discussed and of which the container in the present application constitutes another important embodiment.

Corresponding to the aforesaid ridges, each inner edge of each container corner is provided with a cutout. These cutouts are formed as forming slots which receive the respective ridges of a box which is located in the adjoining lower plane when two boxes of the instant invention are superimposed, forming a vertical stack.

Other details with respect to the benefits and economy of the instant invention will become evident from the following description when considered together with the accompanying drawings in which the details and preferred combinations for the instant invention embodied in a practical embodiment are shown diagrammatically, solely by way of illustration and not of limitation.

BRIEF DESCRIPTION OF THE DRAWINGS

In the drawings:

FIG. 1 diagrammatically shows a portion of a flat stamped cardboard blank from which a container (box) embodying the instant invention is formed.

FIG. 2 is a fragmentary perspective, from the outside looking at a corner of a box formed by erecting the blank of FIG. 1.

Figure 3:
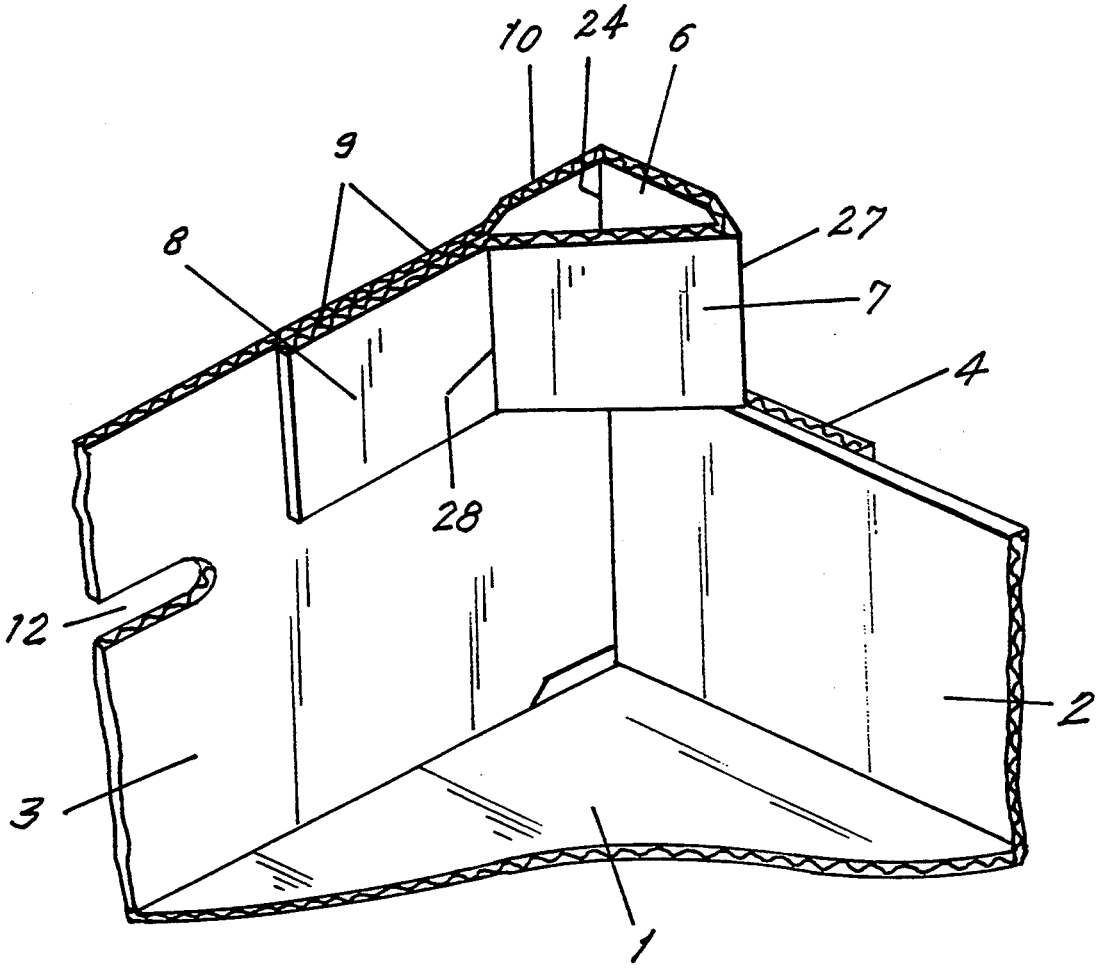
FIG. 3 is a fragmentary perspective, looking at the inside of the box corner of FIG. 2.

Referring now to the drawings, wherein reference numeral 1 designates the bottom of a container, there is formed by erecting blank 99 of FIG. 1. In general the shape of a bottom 1 is a regular rectangle, on the long sides of which there are articulated cheeks 2 or long side panels and on its small sides panels 3. The long sides are indicated by parallel score lines 22 and the small sides are indicated by score lines 23 that extend between lines 22 at opposite ends thereof.

The container erected from blank 99, due to its special design and organization, is suited particularly for the storing and transportation of perishable products such as vegetables, which, although of light weight, are relatively bulky so that in the present case it is desired to obtain a box of large capacity suitable for the correct packing of such products, and for this reason end panels 3 are approximately 25% higher than are long side panels 2.

From FIG. 1 it is seen that each end panel 3 is defined by a side score line 24 that is parallel to a score line 22. Special flaps or extensions 4 are connected to side panels 2 at each score line 24. When an extension 4 is turned around, it surrounds a corner of the box, formed by erecting blank 99 and rests against the end portion of the adjoining long side panel 2, to which it is attached by the application of a layer of rapid-setting adhesive.

Each of the flaps 4 bears a partial transverse cut or incision 5 which creates a lateral extension which forms sectors 7, 8 in an arrangement of three successive sectors 6, 7, 8, continuously articulated to each other, which sectors are connected at score lines 27, 28 and are located within the container constructed of blank 99.

The first or corner sector, designated 6, remains rigidly attached on the flap 4 and protrudes in its entirety above the upper edge of the corresponding long side panel 2, forming a rectangular dihedron with the upper part of the end panel 3, with which it is integral along a portion of score line 24.

The second or corner stiffening sector 7 is turned towards the inside of the container, forming an acute angle with the first sector 6, extending diagonally between the first sector 6 and the inner wall of the end panel 3 of which it forms part, closing the upper part of the corner of the box.

The last sector, designated 8, will be turned, forming an obtuse angle with the intermediate sector 7 in order to apply itself against the inner surface of the end panel 3 to which it is attached by adhesive. The connection of these two parts (end panel 3 and terminal sector 8) there is formed seat 9 the upper edge of which has a double thickness of material, which constitutes an excellent support for placing of one box on another in a stable manner.

Upon turning the flaps 4 which are articulated to the ends of shorter length panels 3, the corners 24 of the container are formed and on the upper edge of the corners there extend angular ridges or crest 10 and, coinciding with them, the lower edge of each corner has a cutout forming groove 11. It will be understood that, by these arrangements, upon the stacking of the trays or boxes, the ridges 10 of the tray located in the lower plane will engage in the corresponding recesses produced by cutouts 11 in the lower edge of the adjoining upper tray. This coupling arrangement between the boxes which form a stack is already provided for and described in detail in previous models of the applicant company itself, in the aforesaid particular in Utility Model 285668.

The container is provided with holes in its end panel 3, as indicated by reference numeral 12, which constitutes a grip for handling the box. Furthermore, the box may have vent holes strategically distributed on the panels or walls 2 and/or 3 and on the bottom 1 of the boxes, which holes (not shown) make it possible to establish suitable aeration of the perishable products packed.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

I claim:

1. A rectangular box shaped container having an open top and being formed by erecting a flat blank constructed of sheet material; said container including:

a generally rectangular base bounded by successive first, second, third and fourth edges, said first and third edges being parallel to each other and at right angles to said second and fourth edges;

first, second, third and fourth panels folded upward from said base and extending along said respective first, second, third and fourth edges, respectively, said first and third panels being relatively tall compared to said second and fourth panels, said second panel being in a plane that intersects planes of said first and third panels at respective first and second corners of said container, and said fourth panel being in a plane that intersects planes of said third and first panels at respective third and fourth corners of said container;

an individual flap connected to each end of each of said first and third panels, being folded inward therefrom with an overlapping portion of said flap being engaged with and secured to an exterior surface of one of said second and fourth panels;

each of said flaps including a strip section spaced substantially from said base and disposed above said second and fourth panels, said strip section including a corner sector, a securing sector, and a corner stiffening sector located between said corner sector and said securing sector, there being an acute angle between said corner sector and said corner stiffening sector, and there being an obtuse angle between said securing sector and said corner stiffening sector;

said corner sector extending from one of said corners and being in a plane common to said overlapping portion of said flap, said corner stiffening sector extending diagonally from said flap and inward of said one of said corners, and said securing sector abutting and being secured to an interior surface of the one of said first and third panels that is in a plane extending through said one of said corners;

an individual short positioning ridge formation associated with each of said corners and projecting higher than said corner stiffening sector; and cutout formations in said first panel, said third panel and said overlapping portions of said flaps to receive individual short positioning ridge formations of another container that is below said container and on which said container rests.

2. A container as defined in claim 1 in which upper edges of said securing sectors and upper edge portions of said first and third panels adjacent said upper edges of said securing sectors lie in a common horizontal plane and cooperate to provide double thickness seating formation which support another container that is above said container and provides cutout formations to receive said positioning ridge formations.

3. A container as defined in claim 1 in which each of said positioning ridge formations includes sections that have different angular locations with respect to said corner with which said positioning ridge formation is associated.

4. A container as defined in claim 2 in which each of said positioning ridge formations includes sections that have different angular locations with respect to said corner with which said positioning ridge formation is associated.

5. A container as defined in claim 1 in which each of said positioning ridge formations extends around a different one of said corners.

6. A container as defined in claim 1 in which each of said positioning ridge formations includes a first ridge section on said corner sector and a second ridge section on one of said first and third panels to which said corner sector is connected.

7. A container as defined in claim 6 in which said first and second ridge sections are contiguous.

8. A container as defined in claim 1 in which said blank before erecting same has said securing sector extend laterally from an adjacent one of said first and third panels and beyond said overlapping portion of the flap that contains said securing sector.

9. A container as defined in claim 1 in which said securing sectors and said corner stiffening sectors are of a height that is equal essentially to the difference in height between said second panel and said first panel at its mid-region.

10. A container as defined in claim 1 in which said second and fourth panels are substantially longer than said first and third panels.

11. A container as defined in claim 10 in which said second and fourth panels are of the same height which is uniform throughout the lengths of said second and fourth panels.

* * * * *

UNITED STATES PATENT AND TRADEMARK OFFICE

CERTIFICATE OF CORRECTION

PATENT NO. : 5,431,335

DATED : July 11, 1995

INVENTOR(S) : D. Emilio Mur GIMENO

It is certified that error appears in the above-identified patent and that said Letters Patent is hereby corrected as shown below:

On the title page,

[30] Foreign Application Priority Data, change "9300583", to --9300593--.

Signed and Sealed this

Eighth Day of September, 1998

*Attest:*

Bruce Lehman

BRUCE LEHMAN

*Attesting Officer*

*Commissioner of Patents and Trademarks*